US007487594B2

(12) United States Patent
Labowski

(10) Patent No.: US 7,487,594 B2
(45) Date of Patent: Feb. 10, 2009

(54) SIGHTING DEVICE

(76) Inventor: Howard R. Labowski, RD #2, Box 13, Sugar Grove, PA (US) 16350

( * ) Notice: Subject to any disclaimer, the term of this patent is extended or adjusted under 35 U.S.C. 154(b) by 52 days.

(21) Appl. No.: 10/554,734

(22) PCT Filed: Apr. 28, 2003

(86) PCT No.: PCT/US03/13192

§ 371 (c)(1),
(2), (4) Date: Dec. 11, 2006

(87) PCT Pub. No.: WO2004/099700

PCT Pub. Date: Nov. 18, 2004

(65) Prior Publication Data

US 2007/0089307 A1 Apr. 26, 2007

Related U.S. Application Data

(63) Continuation-in-part of application No. 10/074,672, filed on Feb. 13, 2002, now abandoned.

(60) Provisional application No. 60/268,823, filed on Feb. 14, 2001.

(51) Int. Cl.
*F41G 1/467* (2006.01)

(52) U.S. Cl. ..... 33/265; 124/87

(58) Field of Classification Search ..... 33/265, 33/282–284, 275 R, 366.11, 366.15; 124/87
See application file for complete search history.

(56) References Cited

U.S. PATENT DOCUMENTS

| | | | |
|---|---|---|---|
| 2,713,727 | A | 7/1955 | Balsam |
| 2,977,559 | A | 3/1961 | Rosenberg et al. |
| 3,114,209 | A | 12/1963 | Foody et al. |
| 3,299,523 | A | 1/1967 | Lea |
| 3,682,552 | A | 8/1972 | Hartman |
| 3,737,232 | A | 6/1973 | Milburn, Jr. |
| 3,747,222 | A | 7/1973 | Benoit |
| 3,914,873 | A | 10/1975 | Elliott, Jr. et al. |

(Continued)

FOREIGN PATENT DOCUMENTS

| | | |
|---|---|---|
| CA | 978737 | 12/1975 |
| DE | 3401855 A1 | 7/1985 |

*Primary Examiner*—G. Bradley Bennett
*Assistant Examiner*—Amy Cohen Johnson
(74) *Attorney, Agent, or Firm*—James C. Simmons

(57) ABSTRACT

A sighting device (20) and method of sighting for a bow (22) or shooting instrument are disclosed. A photo optic cable (15) or other light transmitting flexible tubular member has a first end (19) which receives light from a light emitting diode (LED) (3) or other initiator of light and a second end (30) at which the light is emitted. The initiator is responsive to an indication of an electronic level (5) or other indicator of orientation that the bow (22) is within a predetermined angle (31), of side-wise tilt. The second end (30) of the tubular member is positioned to provide a sight point (30) for the bow (22). Alternatively, the LED is spaced from a fluorescent member (530) providing the sight point at one end thereof, and light from the LED is emitted onto the fluorescent member (530) to provide increased brightness to the sight point end thereof.

16 Claims, 12 Drawing Sheets

U.S. PATENT DOCUMENTS 3,945,127 A 3/1976 Spencer
4,070,763 A 1/1978 Carts, Jr.
4,110,609 A 8/1978 Beer
4,142,297 A 3/1979 Altier
4,159,422 A 6/1979 Okubo
4,163,325 A 8/1979 Hughes
4,170,071 A 10/1979 Mann et al.
4,179,613 A * 12/1979 Koren ..... 250/215
4,215,484 A 8/1980 Lauffenburger
4,312,131 A 1/1982 Scriffignana et al.
4,325,190 A * 4/1982 Duerst ..... 33/265
4,400,887 A * 8/1983 Mason ..... 33/265
4,536,967 A 8/1985 Beitzer
4,561,204 A 12/1985 Binion
4,689,887 A 9/1987 Colvin
4,792,673 A 12/1988 Blackler
4,859,058 A 8/1989 Ekstrand
4,877,324 A 10/1989 Hauri et al.
4,884,809 A 12/1989 Rowan
4,894,921 A 1/1990 Barlow
5,005,308 A * 4/1991 Parks ..... 42/122
5,152,068 A 10/1992 Meister et al.
5,157,839 A 10/1992 Beutler
5,223,650 A 6/1993 Finn
5,224,385 A 7/1993 Floris et al.
5,303,495 A 4/1994 Harthcock
5,315,781 A 5/1994 Beisner
5,339,227 A 8/1994 Jones
5,349,853 A 9/1994 Oehler
5,406,733 A 4/1995 Tarlton et al.
5,435,068 A 7/1995 Thames et al.
5,491,546 A 2/1996 Wascher et al.
5,619,801 A 4/1997 Slates
5,630,279 A 5/1997 Slates
5,634,278 A * 6/1997 London ..... 42/132
5,657,571 A 8/1997 Peterson
5,777,899 A 7/1998 Kumagai
5,914,775 A 6/1999 Hargrove et al.
6,082,012 A 7/2000 McLeod
6,094,829 A * 8/2000 Koestler, III ..... 33/265
6,237,235 B1 5/2001 Feist et al.
6,311,405 B1 11/2001 Slates
6,397,483 B1 * 6/2002 Perkins ..... 33/265
6,494,604 B2 12/2002 Khoshnood
6,516,551 B2 2/2003 Gaber
6,564,462 B1 * 5/2003 Henry ..... 33/265
6,817,105 B2 * 11/2004 LoRocco ..... 33/265
6,978,569 B2 12/2005 Williamson, IV et al.
7,243,432 B1 * 7/2007 Rager ..... 33/265
7,296,358 B1 * 11/2007 Murphy et al. ..... 33/265
2006/0101700 A1 5/2006 Williamson, IV et al.

* cited by examiner

SIGHTING DEVICE

This application is a continuation-in-part of U.S. patent application Ser. No. 10/074,672, filed Feb. 13, 2002 (now abandoned), and priority of U.S. provisional patent application Ser. No. 60/268,823, filed Feb. 14, 2001, is hereby claimed. The disclosure of each of the above applications is hereby incorporated herein by reference.

The present invention relates generally to sighting devices for shooting instruments such as bows and guns. More particularly, the present invention relates to such a sighting device which also acts as an indicator that the shooting instrument is oriented within a predetermined angle of side-wise tilt, for example, that a bow is oriented within a predetermined angle of side-wise tilt, such as 1 degree, of vertical.

There have been many attempts to provide orientation indicators for shooting devices. For example, mineral spirit level indicators have been provided in front of a bow sight. However, such level indicators undesirably require the shooter to look back and forth between the level and the sight.

U.S. Pat. No. 5,634,278 to London discloses a bow sight wherein a microcontroller is programmed, based on inputs from a tilt sensor of the electrolytic type, so that a left LED will light when the bow is tilted to the left a preselected angle and a right LED will light when the bow is tilted to the right a preselected angle. The preselected angles are written into the ROM associated with the microcontroller. The reflections of the side-wise tilt LEDs are viewable in a sight glass. The red reflections of a series of target LEDs are also viewable in the sight glass. A forward or backward tilt indicator will turn on the correct target LED for the yardage of the sighted target. When the red dot reflection of the turned on target LED is aligned with the target through the peep sight in the bow string, the arrow may be shot at the target. This sighting device undesirably requires the user to pay attention to the side-wise tilt lights while viewing the target LED for sighting.

U.S. Pat. No. 4,325,190 to Duerst discloses a bow sight for determining proper range, including a series of mercury tilt switches, each of which becomes operable at a different predetermined angle of bow inclination (forward or backward tilt). A series of light emitting sight pins are connected to the tilt switches via an electronic circuitry that allows for the energization of a different sight pin for a different angle of bow inclination. This sighting device is not directed to providing an indication of a desired orientation for accurate shooting.

U.S. Pat. No. 5,339,227 to Jones discloses an illuminating device for archery aiming scopes which uses an LED light to illuminate both the aiming mark and a fluid filled level. An LED is mounted in a bracket and projects a narrow beam of light onto the aiming mark. Illumination of the level is achieved by means of multiple reflections of the light beam between the lens and the level, with the result that the bubble of the level brightens when the bow is in the desired vertical orientation. This sighting device also undesirably requires the user to pay attention to the level while viewing the aiming mark for sighting.

Many bow sights have a threaded hole in the side of a sight guard to incorporate an LED or other screw-in light that directs light onto the surface of fluorescent pins to make it easier to see the pins at dusk and dawn.

U.S. Pat. No. 3,945,127 to Spencer discloses a bow sighting device wherein sighting pins, to which light from a red lens light or other suitable light source is conducted by light conducting fibers, are used to align an arrow with the target. The power source is activated by a mercury switch which is designed so that, while the bow is in the horizontal position, the power source is off but immediately upon being raised to the vertical position, the power source would be turned on to activate the light and sighting pins. This sighting device also is not directed to providing an indication of a desired orientation for accurate shooting.

U.S. Pat. No. 5,914,775 to Hargrove et al discloses a triangulation rangefinder and sight positioning system wherein the distance from a bow to a target is calculated and inputted to provide automatic adjustment of a movable sight indicator according to the determined distance to the target. The sight indicator comprises a optic cable one end of which is coupled with a light emitting diode (LED) and the other end of which provides the user with a single point of light as a sight. A switching circuit causes the LED to glow one color while motion is being imparted to the sight indicator and to glow another color when the motion has ceased and the sight indicator has been properly positioned. See col. 12, lines 25 to 55, thereof. Thus, an angle of forward or backward tilt for the particular calculated range is determined, and the switching circuit indicates when motion to achieve this determined forward or backward tilt angle is completed.

Other references which may be of interest include U.S. Pat. Nos. 4,142,297; 4,170,071; 4,179,613; 4,689,887; 4,894,921; 5,152,068; 5,224,385; 5,435,068; 5,619,801; 5,630,279; 6,311,405; and 6,494,604.

None of the above references discloses a sighting device which provides an indicator of whether the shooting instrument is within a predetermined side-wise orientation for accurate shooting while being held for shooting and which does not require the shooter to direct his attention away from the sight to the indicator. Greater accuracy with a faster response time is obtainable if the shooter does not have to watch or pay attention to an indicator while also sighting so that all of the shooter's attention is focused on aiming.

It is accordingly an object of the present invention to provide an indicator of whether a shooting instrument, while being held for shooting, is within a predetermined side-wise orientation for accurate shooting and which does not require the shooter to direct his attention away from the sight to the indicator.

In order to provide such an indicator, in accordance with the present invention, a sighting device comprises a member positioned to provide a sight point for the bow or other shooting instrument, an indicator of orientation of the shooting instrument within a predetermined angle of side-wise tilt, an initiator (such as an LED) of light to the member for effecting increased brightness of the sight point, the initiator being responsive to an indication of the indicator that the orientation of the shooting instrument is within the predetermined angle.

In accordance with one embodiment, the member is a photo optic cable which has a first end for receiving light for transmission thereof through the member and a second end (sight point) which emits the transmitted light.

In accordance with another embodiment, the member is a fluorescent member having an end providing the sight point, and the initiator (LED) is spaced from the fluorescent member in position to emit light onto the fluorescent member without obstructing a line of sight of the shooting instrument.

The above and other objects, features, and advantages of the present invention will be apparent in the following detailed description of the preferred embodiment of the invention when read in conjunction with the accompanying drawings wherein the same reference numerals denote the same or similar parts throughout the several views.

DETAILED DESCRIPTION OF THE PREFERRED EMBODIMENT

Figure 1:
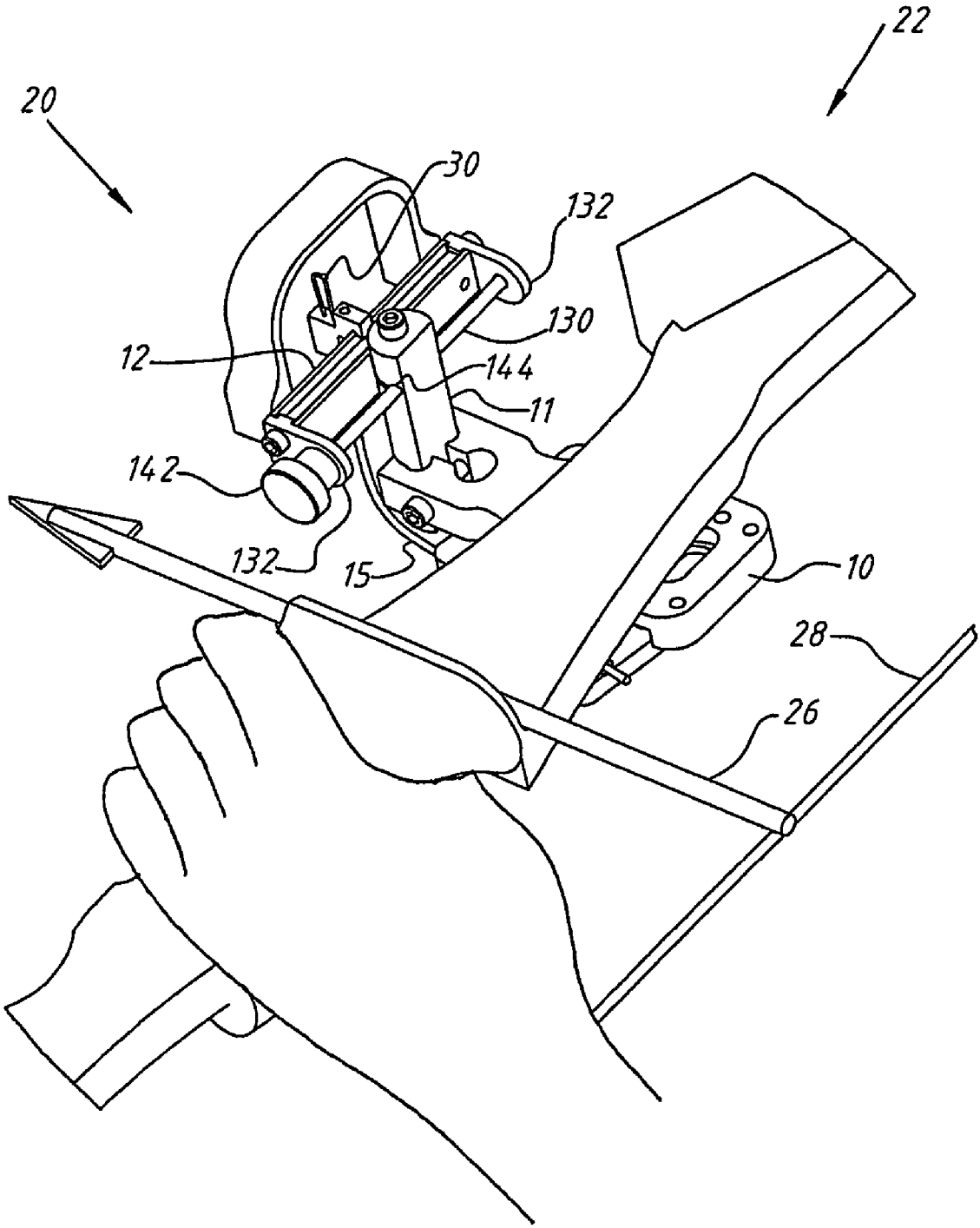
FIG. 1 is a perspective view of a sighting device which embodies the present invention, shown mounted to a bow.
Figure 2:
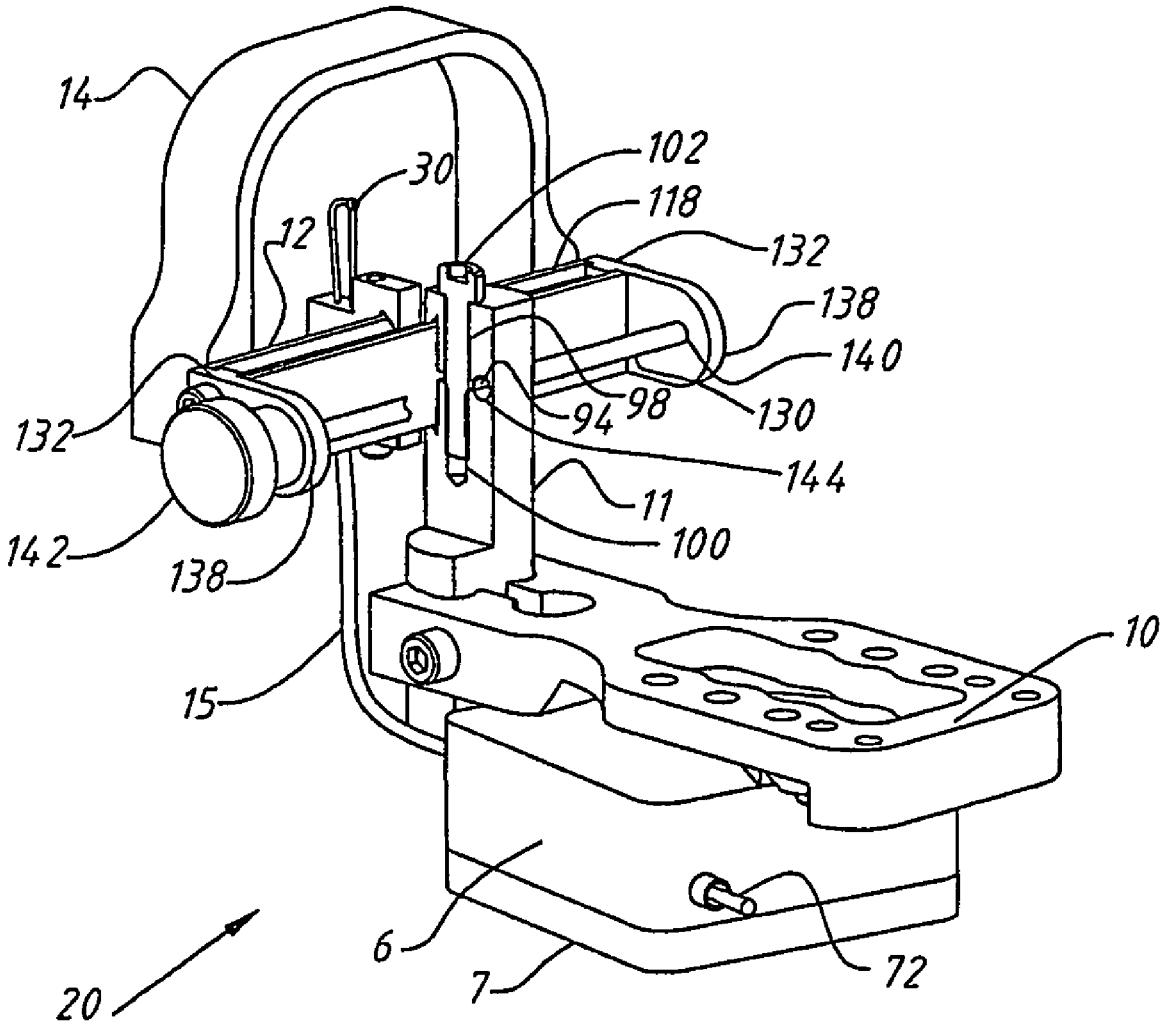
FIG. 2 is an enlarged perspective view thereof, with parts cut away for purposes of illustration.
Figure 3:
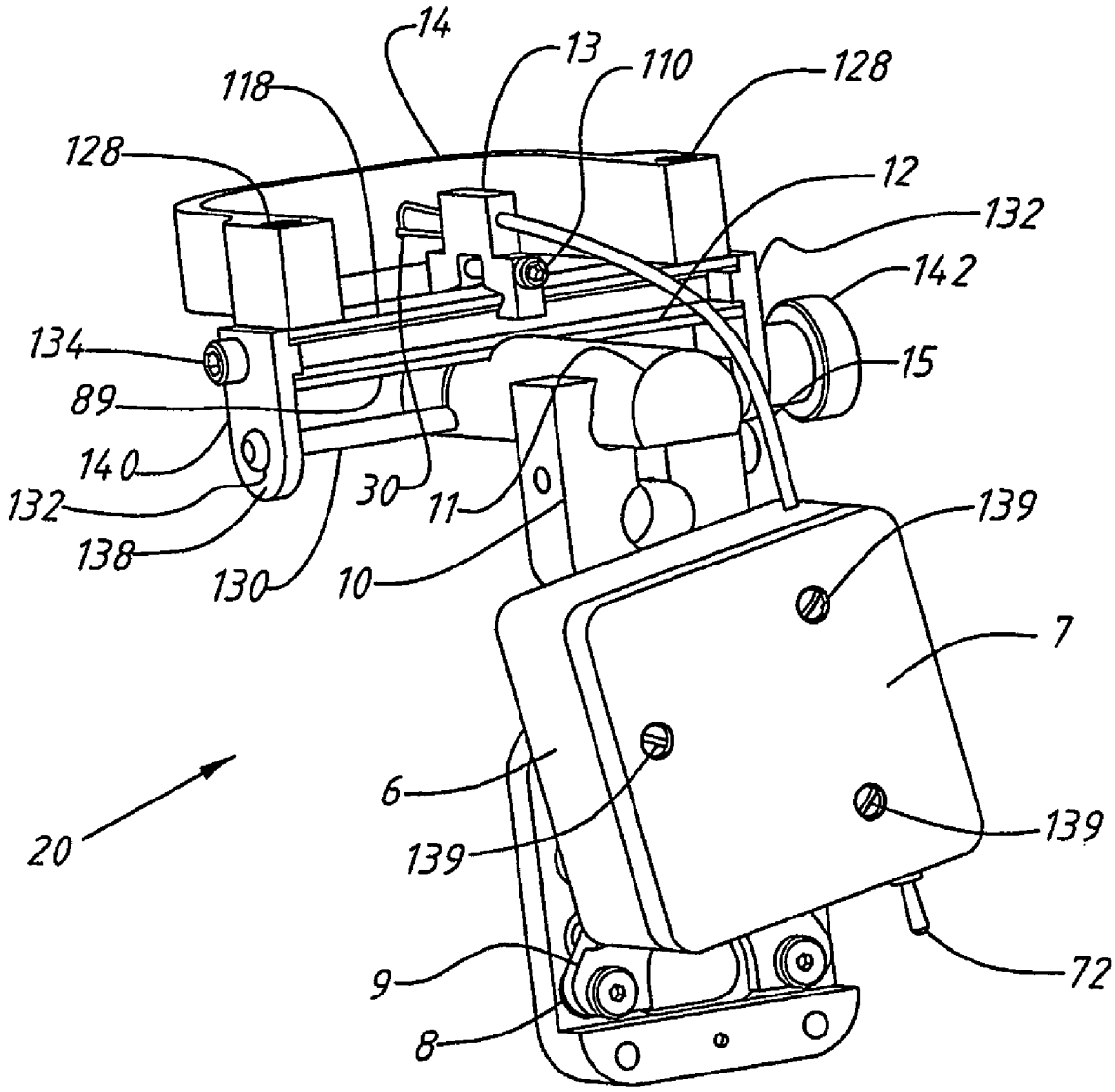
FIG. 3 is an enlarged perspective view thereof.
Figure 4:
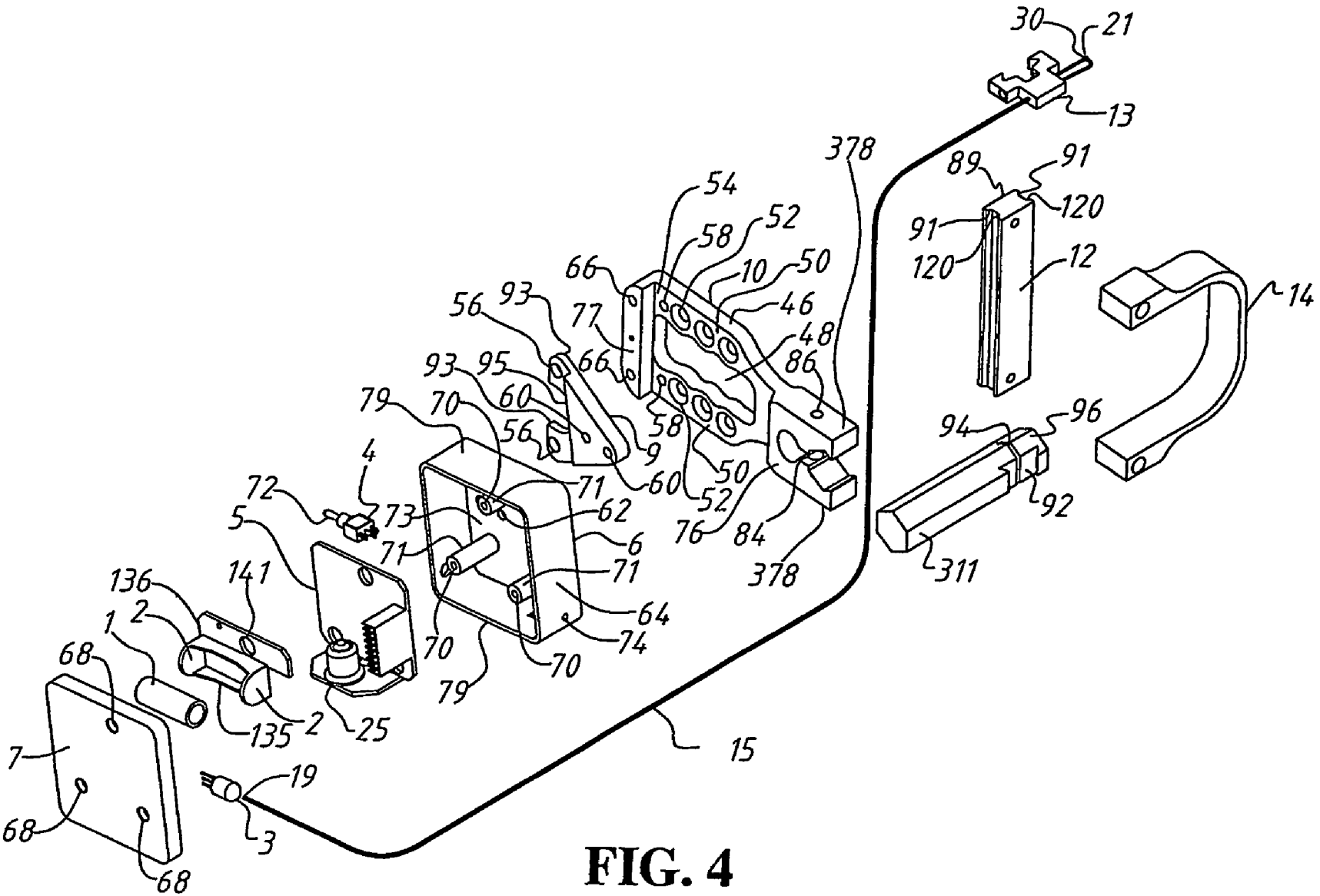
FIG. 4 is an expanded view thereof, showing major parts thereof, with the member 311 and corresponding bracket jaws 378 of FIG. 10 substituted for the corresponding parts of FIG. 6.

Referring to FIGS. 1 to 6, 8, 9, and 10, there is shown generally at 20 a sighting device mounted to a conventional bow 22. It should be noted that some components of the device 20 are not shown in the exploded view of FIG. 4 but are otherwise shown in the other views. The bow 22 is being held by a person's hand 24 in a generally vertical orientation for shooting an arrow 26, by pulling back on the bow string 28 engaged by the arrow and releasing so that the arrow flies forwardly to hit a target if the aim is sufficiently accurate.

A sight point or sight pin is illustrated at 30. Aiming may occur by viewing through a conventional sight peep (not shown) on the bow string and aligning the sight point 30 with the target or by other suitable means utilizing the sight point.

An elongate light transmitting member such as a photo optic cable is illustrated at 15. The cable 15 is at one end 19 (first end) suitably positioned adjacent a light emitting diode (LED) 3 for receiving light, illustrated at 21, emitted therefrom for transmission through the length of the cable 15, and the other end (second end) constitutes the sight point 30. The cable 15 thus transmits the light 21 from the LED 3 along its length to the sight point end 30 where the light 21 is emitted. Thus, the sighting device 20 may be conveniently used as darkness approaches as well as any other time of the day and for competition shooting.

A threshold detector or electronic level 5 is provided to indicate to the shooter whether the bow orientation is deviated side-wise from vertical, either clockwise or counter-clockwise as the shooter faces the bow with the arrow aimed generally toward the target (sometimes referred to as "canting") by more than a predetermined amount (angle), such as, for example, 1 degree. Greater accuracy is obtainable when the bow is properly oriented.

Figure 9:
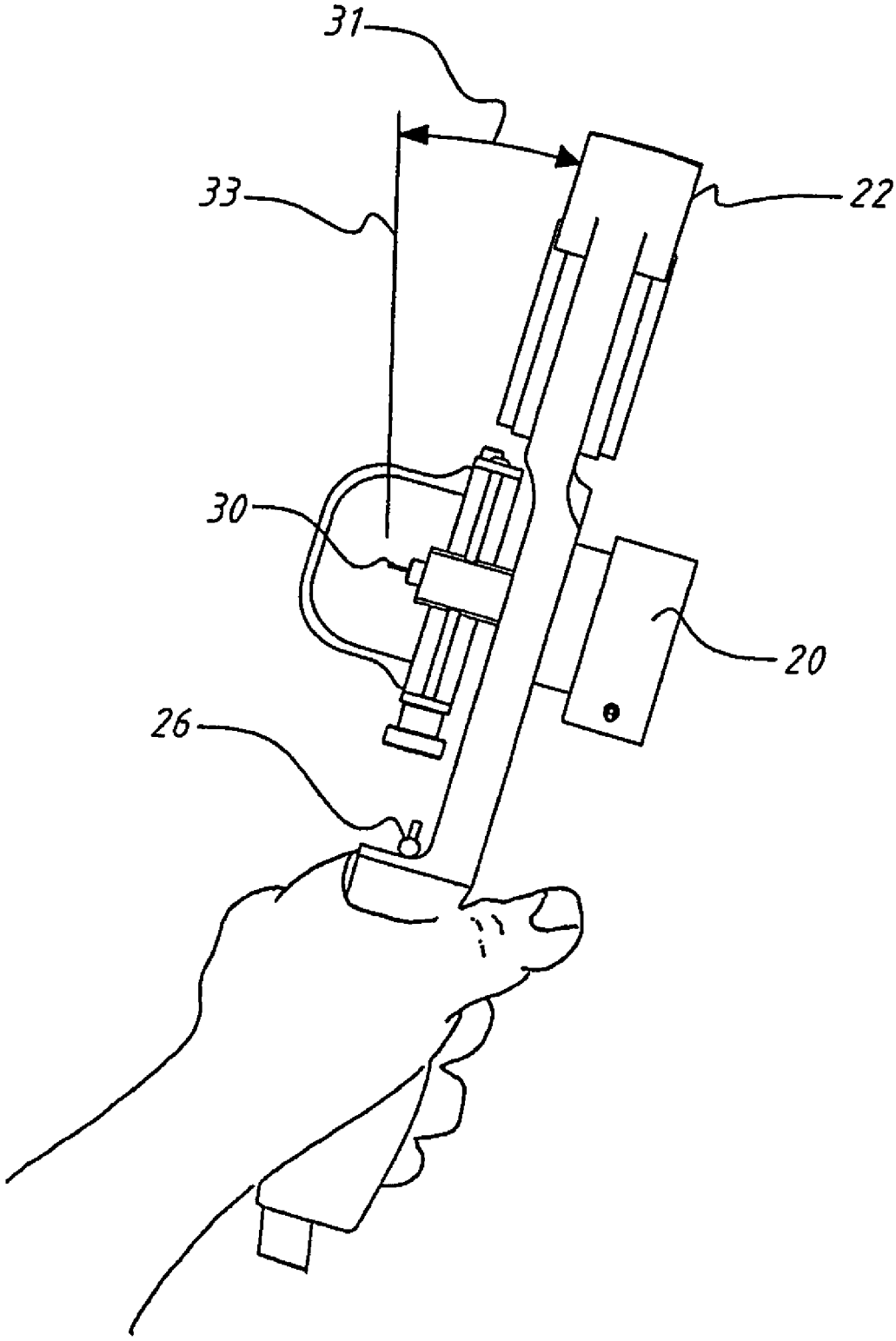
FIG. 9 is a rear view of the bow being held for shooting, illustrating side-wise inclination thereof.

As used herein and in the claims, "side-wise tilt" refers to the tilt, illustrated by angle 31 in FIG. 9, of a bow 22 (or other shooting instrument) either clockwise or counter-clockwise relative to an arrow 26 held in the bow for shooting, i.e., in a plane normal to the arrow or normal to the direction of shooting so that when tilting side-wise, the bow may be said to be rotating about the axis of the arrow. Side-wise tilt is thus differentiated from forward or backward tilt of the upper end of the bow relative to the lower end thereof, i.e., tilting of the bow in a plane which contains the line of sight. The present invention is directed to minimizing side-wise tilt so that the side-wise tilt, angle 31 (FIG. 9), at the time of shooting is as close to zero (vertical) as possible and, if not exactly zero, then no more than a predetermined angle 31 relative to vertical 33, for example, about 1 degree from vertical 33, either clockwise or counter-clockwise.

As used herein and in the claims, "predetermined angle" refers to an angle for which the instrument 20 is calibrated or set before use thereof, as opposed to a "determined angle" for which an instrument is constructed to calculate or otherwise determine during use of the instrument, such as an angle of forward or backward tilt which is determined (calculated) by an instrument based on a range which is also determined (calculated) by the instrument. Thus, in accordance with the present invention, the angle 31 is not calculated or otherwise determined during use of the instrument but is instead "predetermined," i.e., calibrated or set in the instrument before use thereof and not subject to change during use of the instrument.

Figure 8:
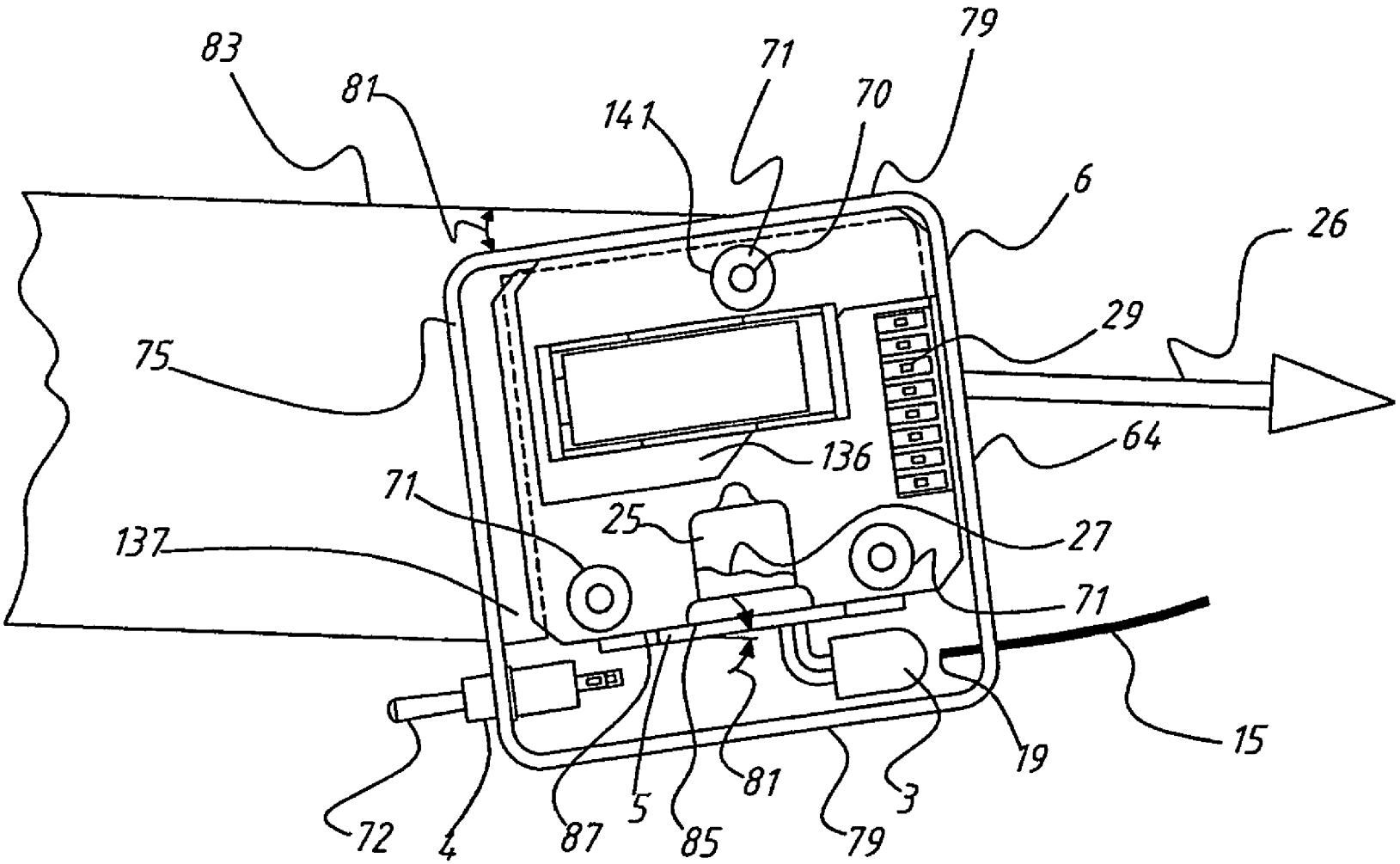
FIG. 8 is a plan view showing the lay-out of detector and emitter components within a housing thereof.

The level 5 comprises an inclinometer 25 in the form of an enclosed chamber containing a fluid, illustrated at 27, and electrically connected on a circuit board 29 to detect changes in inclination of the fluid 27 (side-wise of the direction of aim of the arrow 26, i.e., in a direction into and out of the paper as seen in FIG. 8) and provide an electrical output indicative of the change, using principles commonly known to those of ordinary skill in the art to which this invention pertains. The electronic level 5 may, for example, be a SSY0187 threshold angle detector made by Spectron Systems Technologies, Inc. of Hauppauge, N.Y. 11788, or any other suitable leveling detector such as disclosed in U.S. Pat. No. 4,536,967 (assigned to a related company of Spectron Systems Technologies, Inc.) the disclosure of which is incorporated herein by reference. This patent also refers to other tilt sensors in U.S. Pat. Nos. 4,163,325; 4,159,422; 2,977,559; 3,114,209; 3,299,523; 2,713,727; and 4,312,131 which patents (providing additional examples of tilt sensors which may be used or adapted to be used, as may be suitable, as the electronic level 5) are also incorporated herein by reference.

When a leveling indicator is positioned separate from the sight point, the shooter must move eye contact from level indicator to sight point and from sight point to level indicator many times before shooting or at least must focus attention on the level indicator, which may slow down response and decrease accuracy. In order to eliminate such a distraction so that faster response time and greater accuracy may be achieved, in accordance with the present invention, the electronic level 5, which has a suitable processing unit (not shown), is electrically connected to the LED 3, as hereinafter discussed, so that the sight point 30 is also the level indicator. The leveling detector 5 senses the side-wise (i.e., crosswise to the direction of aim of the arrow 26) angle, illustrated at 31 in FIG. 9, of tilt relative to a vertical orientation, illustrated at 33, of the bow 22. Thus, the shooter has only to watch one spot, i.e., point 30, to both aim and receive an indication that the bow is suitably level side-wise, for greater accuracy and response time.

The LED 3 is preferably of a bi-colored type, for example, for emitting both red and green light, the red light indicating that the bow is not within the predetermined orientation and shooting should not proceed, and the green light indicating that the bow is within the predetermined orientation so that shooting can proceed. The leveling detector 5 thus turns on the green of the LED 3 when the angle 31 is less than the predetermined angle, for example, within about 1 degree of vertical 33, and turns on the red of the LED 3 when the angle is greater than the predetermined angle, i.e., greater than about 1 degree of vertical 33. Of course, any other suitable combination of colors may be used, including switching the colors or meanings given by the red and green lights. The wiring therefor will be discussed hereinafter with reference to FIG. 5.

It may be desired to alternatively use two LED's, one for emitting a red light and one for emitting a green light, both such LED's being angled to a focal point for the optic cable 15 to pick up the colored light from both LED's. In such an alternative embodiment, instead of the wiring shown and hereinafter described with respect to FIG. 5, lines 38 and 42 would be connected to the green light, and lines 40, 42, and 44 would be connected to the red light, line 42 being the common wire.

If desired, the LED 3 may be provided to emit only one color of light, the presence of the light at sight point 30 indicating that the bow is within the predetermined orientation so that shooting can proceed and the absence of light at sight point 30 indicating that the bow is not within the predetermined orientation and shooting should not proceed.

The LED 3 is suitably mounted in a component box or housing 6 formed of a suitable plastic (or other suitable) material and which has a cover lid 7 which is attached by suitable screws 139 which are received in three (or other suitable number) countersunk apertures, illustrated at 68, respectively in the cover lid 7 and threadedly received in threaded apertures, illustrated at 70, formed in posts 71 which are provided to extend upright from the floor 73 of the box 6 or otherwise suitably formed in the box. The photo optic cable 15 passes out of the box 6 through an aperture, illustrated at 74, in the forward wall 64.

A DC battery 1 or other suitable power source providing between about 5 volts and about 15 volts, for example, a 12-volt battery, is provided to power the sighting device 20, the circuitry being changed by addition of resistors or otherwise as appropriate to the particular power source in accordance with principles commonly known to those of ordinary skill in the art to which this invention pertains. The battery 1 is held in place by a holder 135 which has electrical connectors 2 at the ends thereof and which is attached to a fiber plate 136 by glue or other suitable means. The plate 136 is seated on a ledge, illustrated at 137, on the inside of the housing 6 to keep the battery 1, holder 135, and plate 136 from coming into contact with the threshold detector 5 while desirably minimizing the housing thickness. This allows the size of the housing 6 to be reduced to, for example, 2 inches by 2 inches by 1 inch deep. However, it should be understood that the housing 6 may be otherwise suitably shaped and sized. The plate 136 is also held in position by one of the posts 71 which extends through a hole, illustrated at 141, in the plate 136. The plate 136 is held tight on the ledge 137 by slight pressure on the battery 1 from the housing cover 7.

Suitably mounted in an opening in the rear wall 75 of the box 6 is a switch 4 to provide easy accessibility to the toggle 72 thereof. The switch 4 may, for example, be a toggle switch sold by Radio Shack and identified as switch no. 275-645B.

Figure 5:
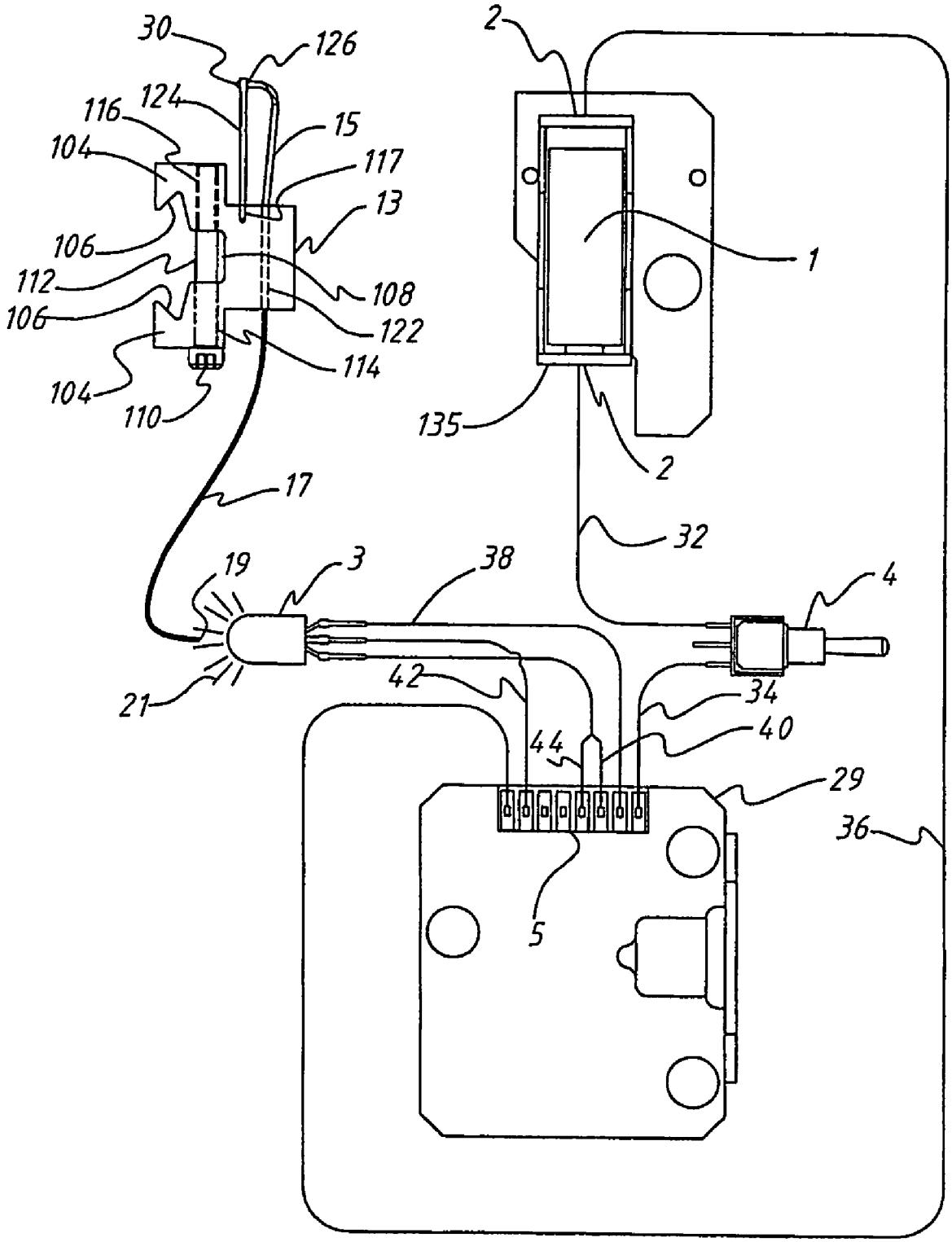
FIG. 5 is a schematic view of the electrical circuitry thereof.

The battery 1 is connected, via connectors 2, in series with the switch 4 and the level detector 5 by means of wires 32, 34, and 36, as illustrated in FIG. 5. The level detector 5 is electrically connected to the LED 3 via lines 40, 42, and 44 to switch it to emit red light and via lines 38 and 42 to switch it to emit green light. The light passes through photo optic cable 15 to end 30 where it appears as a green or red lighted dot, which becomes the bulls eye or sight pin or sight point and which also serves when lighted green that the bow is within the predetermined orientation 31 for shooting. Since the shooter need only focus on the lighted sight point 30, greater accuracy and faster response time is achievable.

The angle of tilt signal from the inclinometer 25 is, as suitable, amplified and demodulated and routed to the processing unit of the level detector 5. The processing unit may, for example, be preset with the predetermined value of the threshold angle 31 and have outputs to close a first switch (not shown) in the line 34 from the battery 1 to the indicator 3 when the sensor input of the value of the angle 31 is less than the threshold high (i.e., less than, for example, plus one degree) and to close a second switch (not shown) in the line 34 when the sensor input is greater than the threshold low (i.e., greater than, for example, minus one degree). Thus, both the first and second switches must be closed (indicating that the value of angle 31 is greater than minus one degree and less than plus one degree) for the indicator 3 to be powered by battery 1 so as to emit light. In order to prevent distracting blinking of the sight point 30, hysteresis and delay values are desirably preset in the processing unit, in accordance with principles commonly known to those of ordinary skill in the art to which this invention pertains, to suitably delay the closures of the first and second switches until the threshold values are held for a selected period of time. Such a processing unit providing for such delay may also be suitably incorporated in the hereinafter embodiment of FIGS. 11 and 12.

The sighting device 20 (as well as sighting device 520 discussed hereinafter) may also include, if desired, a suitable indicator for roll (front to back inclination).

The device 20 is attached to bow 22 by bracket 10 which has a mounting portion 46 having a centrally disposed opening or cutout, illustrated at 48, extending therethrough and defining a pair of legs 50. Each leg 50 has a series of, for example, three spaced countersunk apertures, illustrated at 52, for receiving suitable screws (not shown), which are then screwed into threaded apertures (not shown) in the bow 22 for attachment thereto. The series of pairs of apertures 52 in the legs allows the mounting bracket 10 to be adjustably mounted to the bow 22, by selecting a pair of apertures corresponding to the desired sight position, to thereby adjust the position of the sight 30.

The face 54 of the bracket 10 facing away from the bow 22 is recessed along the mounting portion 46 to define a ledge 77 on the bracket end. A triangular (or otherwise suitably shaped) adapter plate 9 is received within the recess adjacent the face 54 and in abutting (or near abutting) relation with the ledge 77. A pair of suitable screws (not shown) are received in apertures, illustrated at 56, in a pair of relatively thin portions 93 respectively of the adapter plate 9 and threadedly received in threaded apertures, illustrated at 58, in the ends of the legs 50 respectively to attach the adapter plate 9. Washer shims 8, as needed for each screw, are shown received by the screws between the adapter plate 9 and the bracket 10 to adjust the orientation of the inclinometer 25. Illustrated at 66 in the ledge portion 77 are two spaced threaded apertures the purpose of which is to insert bolts to attach a bow quill.

The adapter plate 9 has two spaced threaded apertures, illustrated at 60, in an increased thickness portion 95 thereof along its centerline vertically (i.e., along a line which bisects a line extending between the apertures 56), and the component box 6 has mating apertures, illustrated at 62, in its floor 73 for attaching the component box 6 to the adapter plate 9 by screws (not shown) received in the apertures 62 and threadedly received in apertures 60 respectively or by other suitable means.

It was found that when the side walls 79 (which extend between the front and rear walls 64 and 75 respectively) of the component box 6 are oriented to lie along the line of sight (or parallel to the arrow 26), the orientation of the inclinometer 25 when the line of sight is downwardly (such as when one is shooting at a deer from up in a tree stand) is such that the fluid 27 masses in the forward portion of the inclinometer 25 and therefore does not provide reliable tilt indications. In order that the inclinometer 25 may be suitably oriented for aiming of the arrow 26 both straight ahead and downwardly from a tree stand or the like, in accordance with a preferred embodiment of the present invention, the component box 6 is attached to the adapter plate 9 so that the side walls 79 extend upwardly relative to the line of sight (arrow 26) at an angle illustrated at 81 in FIG. 8 (the side wall 83 of the bracket 10 being in this embodiment parallel to the line of sight). The angle 81 should be such that, when the line of sight is horizontal, the fluid 27 does not congregate too much to the rear and, when the line of sight is downwardly such as when shooting downwardly from up in a tree stand, the fluid 27 does not congregate too much to the front of the inclinometer 25 so that reliable tilt indications can be obtained whether shooting horizontally or downwardly from up in a tree stand. This angle 81 is preferably about 10 degrees. Alternatively, it is envisioned that the portion 87 of the circuit board 29 on which the inclinometer 25 is mounted may be inclined at the angle 81 to achieve the same effect. Thus, the floor 85 of the inclinometer 25 is inclined relative to the line of sight by the angle 81, and this is achieved by inclining the component box 6 or by inclining the circuit board portion 87 or by other suitable means.

Figure 6:
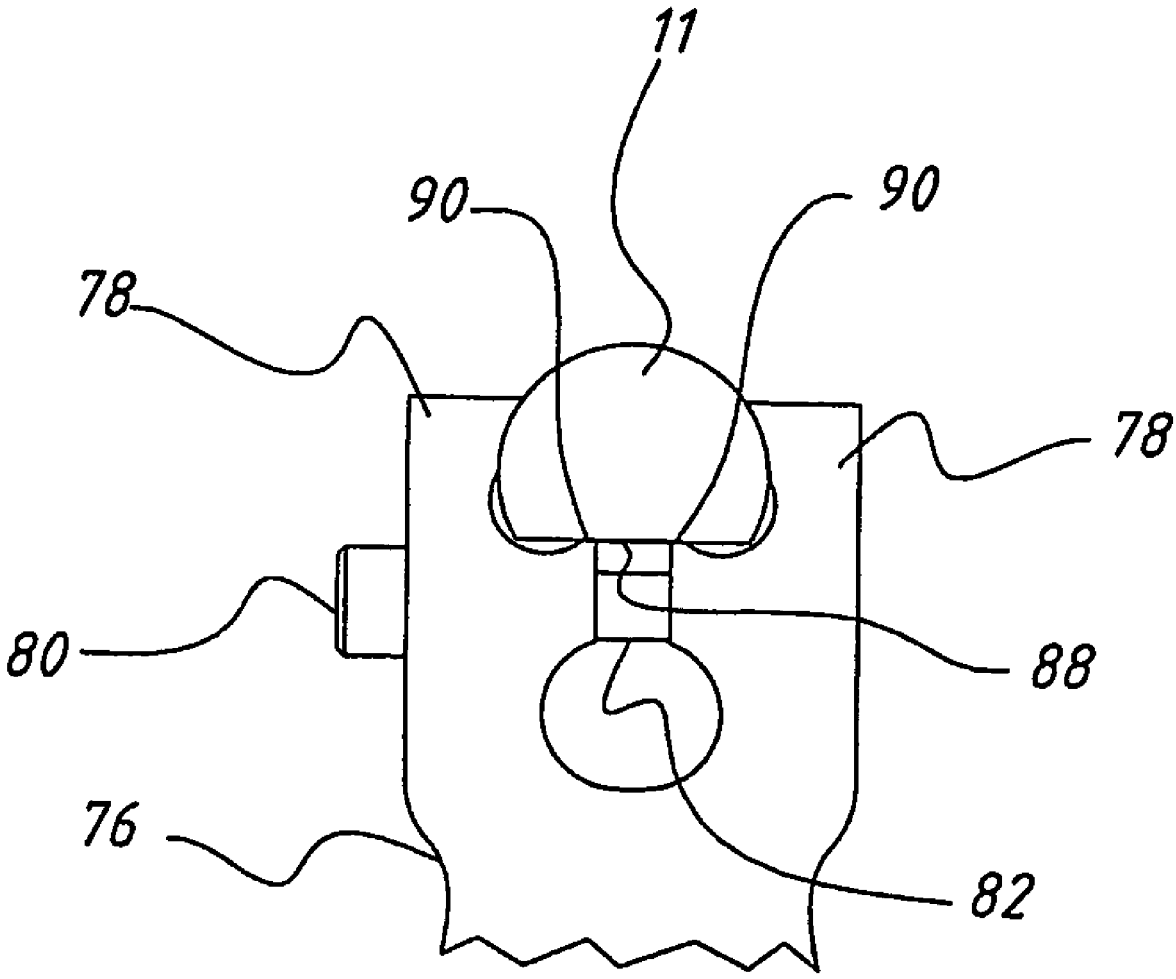
FIG. 6 is an enlarged detail view of a portion thereof.
Figure 10:
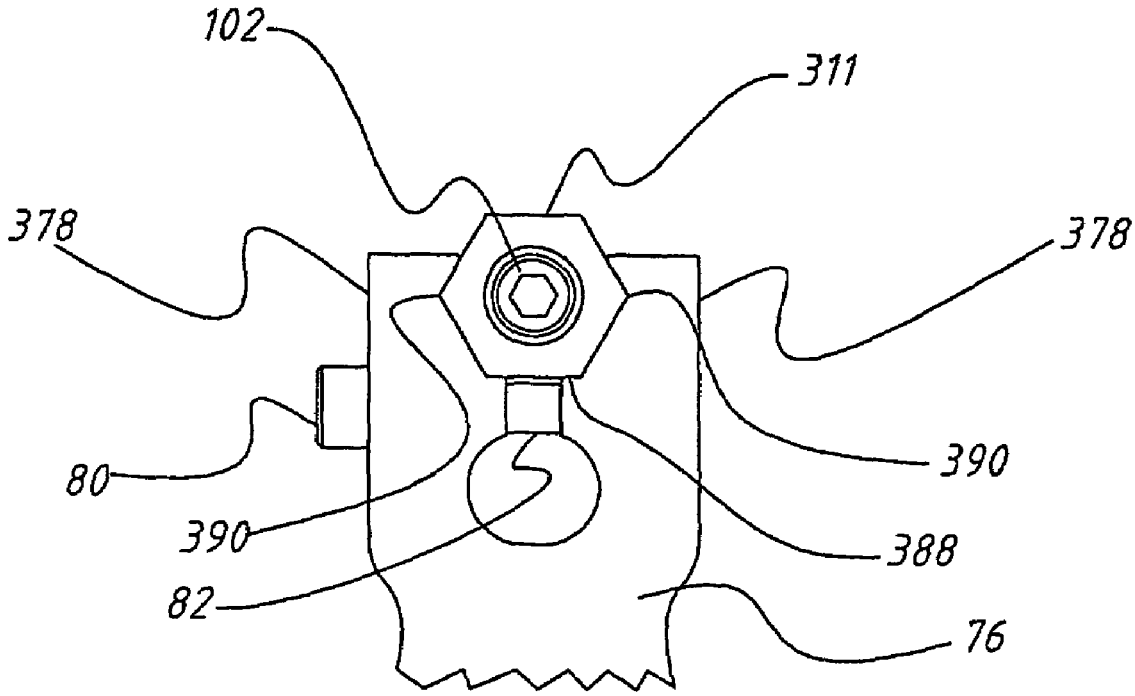
FIG. 10 is a detail view similar to that of FIG. 6 illustrating an alternative embodiment of the portion of FIG. 6.

A second portion 76 of the mounting bracket 10 is shaped to define a pair of jaws 78 which are urgable together by a suitable internal hex-head screw 80 whose shank 82 is received in aperture, illustrated at 84, in one jaw 78 and threadedly received in a threaded aperture, illustrated at 86, in the other jaw 78 to grip member 11. The member 11 is an elongate member which has a truncated circular cross-section with the circular portion extending through a little more than 180 degrees to provide a flat elongate surface 88, as illustrated in FIG. 6. The jaws 78 are formed to provide a pair of projections 90 respectively upon which the flat surface 88 lies, the jaws extending alongside the circular surface thereof to retain the member 11 within the jaws. Alternatively, instead of the truncated circular member 11, a cross-sectionally hexagonal shaped member 311 may be provided, as illustrated in FIG. 10, and jaws 378 (instead of jaws 78) shaped to receive a pair of opposite apexes 390 thereof and thereby enclose over half of the circumferential surface 388 thereof including enclosing a major diameter (between a pair of opposite apexes) thereof for positive retention between the jaws 378. It should of course be understood that the member 11 or 311 may be otherwise suitably shaped (and the jaws shaped accordingly) for its retention within the jaws.

The member 11, which when mounted to a bow held in position for shooting, is oriented horizontally, is connected to a vertical member 12, as hereinafter described, which is in turn connected to the sight pin holder 13, as also hereinafter described. Orientations of members as described herein are defined with reference to the device 20 mounted to a bow which is held in a normal position for shooting, as seen in FIG. 1.

The member 11 is a horizontal sight pin extension and adjustment member for extending the sight pin 30 horizontally into position. The sight pin position horizontally may also be adjusted by loosening screw 80 and sliding extension member 11 between the jaws 78 until the desired position horizontally is reached, then tightening the screw 80 to lock the extension member 11 to the desired position.

An end portion of the extension member 311 has a dove-tail slot, illustrated at 92, and extension member 11 similarly has a dove-tail slot in the circular surface thereof, and this end portion is split at the dove-tail slot 92, i.e., it has a slit, illustrated at 94, located centrally of the dove-tail 92 and extending from the floor of the dove-tail most of the way through the circular portion of the member 311 as well as member 11 (extending to a distance of, for example, about ⅛ inch from the flat surface 88 of the member 11, which member 11 may have a thickness, perpendicular to the flat surface, of, for example, about ½ inch) and disposed at a distance of, for example, about ⅜ inch from the end of member 11 or 311. The slit 94 thus defines an end portion 96 of the member 11 or 311 which can flex slightly relative to the main body of the member 11 or 311. An aperture, illustrated at 98, extends centrally axially through the end portion, and a threaded aperture, illustrated at 100, extends in the body of the member centrally axially from the slit 94. An internal hex head screw 102 is received in aperture 98 and is threadedly received in aperture 100.

A first side 89 of the elongate generally rectangular vertical adjustment bracket 12 is shaped with edge projections 91 to be received in the dove-tail slot 92 whereby the bracket 12, with the screw 102 loosened, is slidable to the desired vertical position for adjusting the height of the sight pin 30. The screw 102 is then tightened to clamp the bracket 12 at the desired position.

In order to more precisely adjust the position of the sight pin 30 vertically, a pair of end plates 132 are suitably attached to the ends respectively of bracket 12 such as by screws 134 respectively. The plates 132 may each have a projecting portion (not shown) which is snugly received in a slot (not shown) in the corresponding end of the bracket 12 to precisely locate the plates 132. The plates 132 have portions 138 which extend outwardly from the side 89 of the bracket 12. Each of the plate portions 138 has an aperture, illustrated at 140. An elongate threaded rod 130 extends through the apertures 140 and is rotatably held in place, one end having a head or enlarged portion (not shown) which engages the outer surface of the respective plate 132 and is too large to pass through the respective aperture 140, and a knob 142 being fixedly received on the other end by a set screw (not shown) or other suitable means for turning the threaded rod 130. The threaded rod 130 is threadedly received in a threaded aperture, illustrated at 144, in the member 11 for movement of the member 11 therealong as the knob 142 is turned. Vertical adjustment of the sight pin 30 may thus be made by loosening screw 102 and turning the knob 142 either clockwise or counter-clockwise to rotate the threaded rod 130 to effect traveling of the member 12 thereby causing the sight pin 30 to go up or down. When the sight pin 30 is at the desired position, the screw 102 may be tightened with the result of maintaining the adjusted sight pin position. It should be understood that the sighting device 20 may, if desired, be provided without such an adjustment feature.

The sight pin holder 13 has a pair of jaws 104 defined by a dove-tail slot, illustrated at 106 in FIG. 5, and a slot, illustrated at 108, extending inwardly from the floor thereof and centrally thereof. An internal hex head screw 110 has a shank 112 which is received in an aperture, illustrated at 114, in one jaw 104, extends across the slot 108 and is threadedly received in threaded aperture, illustrated at 116, in the other jaw 104. The second side 118 of bracket 12 is shaped, similarly to the shape of the first side 89, to have a pair of edge projections 120 to be received in the dove-tail slot 106 whereby the sight pin holder 13, with the screw 110 loosened, is slidable to the desired position along the length of the bracket 12. The screw 110 is then tightened to clamp the sight pin holder 13 to the bracket 12 at the desired position.

The photo optic cable 15 comprises a clear or see-through plastic material which has a black covering 17 of plastic or rubber or other suitable material. In order to reduce distraction of the black covering 17 near the sight pin 30, the sight pin end portion of the cable 15 is preferably stripped of the covering 17. This also allows the cable diameter to be reduced from, for example, about 0.078 inch when covered to about 0.062 inch when stripped, which smaller diameter may also serve to reduce distraction. The stripped end portion of the cable 15 is received or fed through a tight passage, illustrated at 122, through the upper portion of the holder 13 and extends beyond the passage 122 a distance of, for example, about ¾ inch to the sight pin 30.

A bracing member 124, attached to the holder 13 such as, for example, by pressing into a hole, illustrated at 117, extends outwardly from the holder 13 and terminates at an end which is shaped to have a hole, illustrated at 126, therein. The end or sight pin 30 of the photo optic cable 15 is threaded through the hole 126 so that the bracing member 124 may precisely maintain the sight pin position. In order to insure that the cable 15 doesn't disengage from the hole 126, its end, after passage through the hole 126, may be melted slightly about its outer surface and allowed to cool to form an obstruction to passage of the cable end back through the hole 126.

A generally U-shaped protective guard member 14, composed of see-through Lexan plastic or other suitable material, is attached to the ends of the second side 118 of bracket 12 by screws 128 or other suitable means to protect the sight pin 30, for example, to prevent it from being accidentally touched by an arrow 26 or caught on tree limbs and the like. The guard 14 may of course be otherwise suitably shaped. For example, the guard may be circular and opaque and may suitably have openings or cutouts in its circular wall, and the wall edge facing the shooter may be brightly colored, such as bright orange.

The component box 6 and its cover 7, the adapter plate 9, the bracket 10, the sight pin extension 11, the bracket 12, the holder 13, and the brace 124 may be composed of steel, aluminum, plastic, or other suitable material, and the components may be attached together in ways other than as shown.

If desired, more than one sight pin 30 may be positioned for correspondingly different ranges. Additional modifications are also envisioned. For example, someone may wish to have the sight pin light up only when the bow is correctly oriented and to have one or more additional lights to warn the shooter when the bow is not correctly oriented.

In accordance with the present invention, the sighting device 20 may also be adapted for use with a gun for long range shooting. For such a use, the component box 6 is preferably a long housing which extends along the scope. For example, the housing may be about 1¼ inch square and 4 to 6 inches long and mounted to the side or top of a gun scope by means of a suitable bracket.

Figure 7:
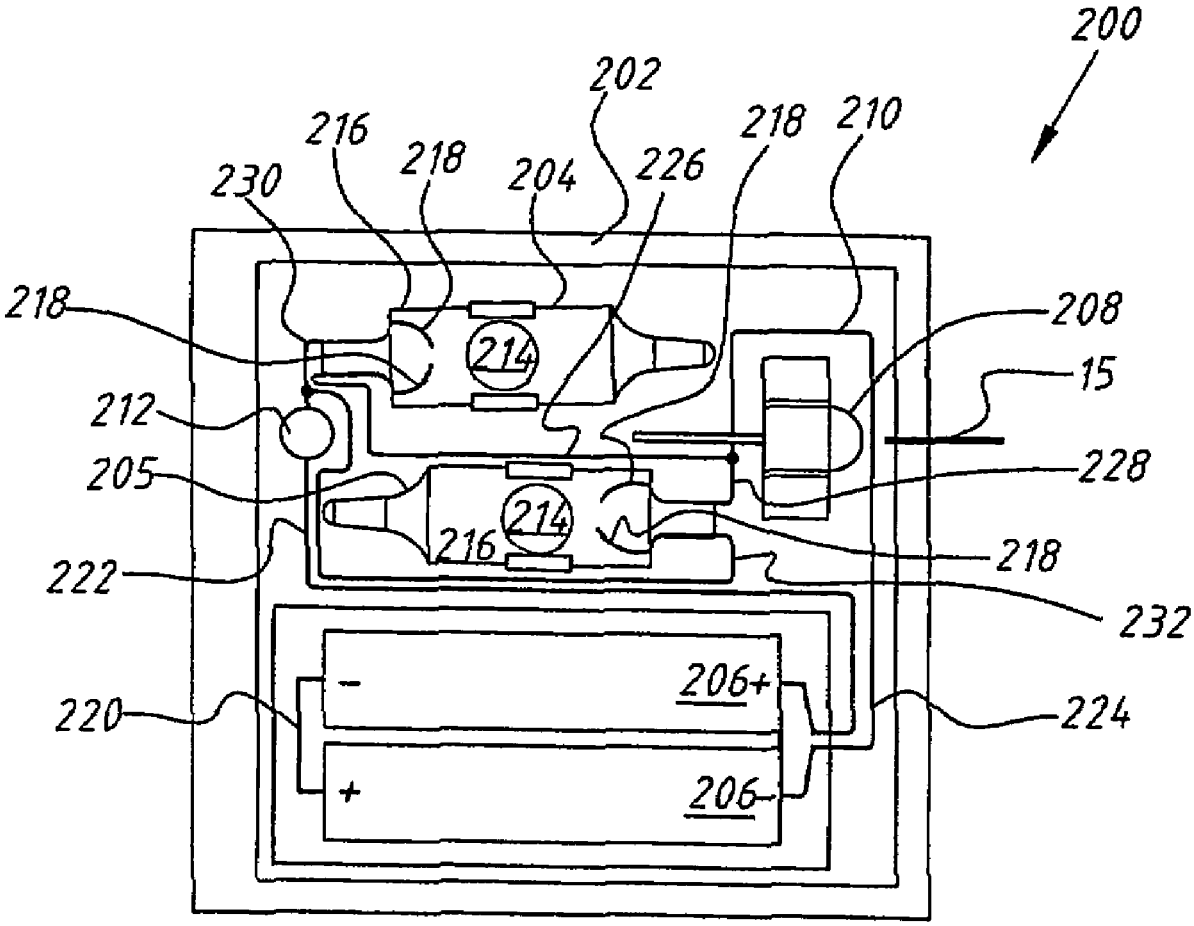
FIG. 7 is a generally schematic view of an alternative embodiment thereof.

It should be understood that the present invention is not limited to the level detector illustrated at 5 in FIGS. 1 to 6, 8, and 9, and other suitable level detectors are meant to come within the scope of the present invention. Referring to FIG. 7, there is shown generally at 200 a sighting device in accordance with an alternative embodiment of the present invention wherein such an alternative level detector is used. The device 200 includes a suitable housing 202 in which are contained a pair of mercury switches 204 and 205 electrically connected by circuit 210 to batteries 206, which may be, for example AA size, and to LED 208 as described hereinafter, the circuit 210 being opened and closed by switch 212 to turn on power to the device 200, and the light provided by LED 208 being transmitted to the sight pin 30 by photo optic cable 15 similarly as described for device 20.

Each of the mercury switches 204 and 205 contains a quantity of mercury 214 within a container 216 and has a pair of terminals 218 which are of the normally open single pole type as shown for contact of the mercury 214 therewith to close the respective switch 204 and 205. The LED 208 is of a type which emits only a single color light, for example, red light.

The circuit 210 includes a connection of a negative terminal of one battery 206 to a positive terminal of the other battery 206 as shown schematically by conductive wire 220. The other terminals of the batteries 206 are connected to a terminal of the switch 212 and a terminal of the LED 208 respectively by conductive wires 222 and 224 respectively. The other terminal of the LED 208 is connected to a terminal 218 of each of the switches 204 and 205 by parallel conductive wires 226 and 228 respectively. The other terminal 218 of each of the switches 204 and 205 is connected to the other terminal of the switch 212 by parallel conductive wires 230 and 232.

The switches 204 and 205 are reversed so that the terminals 218 of one switch (204 in FIG. 7) are to the left and the terminals 218 of the other switch (205 in FIG. 7) are to the right. Since the circuit comprising wires 226 and 230 for switch 204 and the circuit comprising wires 228 and 232 for switch 205 are in parallel, the closing of either switch 204 or 205 by movement of the mercury 214 into contact with both terminals 218 of the respective switch (which occurs when the switches 204 are tilted by more than the predetermined angle 31) causes power to be supplied from batteries 206 to the LED which accordingly emits red light which is transmitted through the cable 15 and emitted at sight pin 30 (meaning that the bow is not within the correct orientation for shooting). Thus, when the device 200 is tilted to the right, meaning that the bow to which it is attached is also tilted to the right, by more than a predetermined amount 31, such as 1 degree, the mercury quantities 214 move to the right to contact the right ends of the containers 216 respectively with the mercury 214 for switch 205 connecting with the terminals 218 thereof to close the switch 205 to allow passage of current through wires 228 and 232 to cause the LED 208 to emit a red light, indicating at the sight pin 30 to the shooter not to shoot. Likewise, When the device 200 is tilted to the left, meaning that the bow to which it is attached is also tilted to the left by more than the predetermined amount, the mercury quantities 214 move to the left to contact the left ends of the containers 216 respectively with the mercury 214 for switch 204 connecting with the terminals 218 thereof to close the switch 204 to allow passage of current through wires 226 and 230 to cause the LED 208 to emit a red light, again indicating at the sight pin 30 to the shooter not to shoot. However, when the device 200 is oriented within the predetermined amount 31, i.e., when the bow to which the device 200 is attached is oriented within, for example, about 1 degree of vertical, the mercury quantities 214 move to the centers of the containers 216 respectively (or intermediate the ends thereof), as shown in FIG. 7, so that the contacts 218 of neither of the switches 204 and 205 is closed with the result that the circuit 210 is open and the LED 208 as well as the sight pin 30 does not emit light. In this case, the absence of light at the sight pin 30 indicates that the bow is adequately oriented (within the predetermined angle 31 of inclination from vertical) for shooting. The amount of the predetermined angle 31 of tilt is adjustable by changing the orientation of the switches 204 and 205 relative to the walls of the housing 202.

The device 200 may alternatively have an LED which, similar to LED 3, is bi-colored, for example, emitting alternately green (when the bow is level or oriented within the predetermined angle for shooting) and red (when the bow is not oriented within the predetermined angle so that shooting should not occur) light and suitably wired, in accordance with principles commonly known to those of ordinary skill in the art to which this invention pertains, therefor. This would require an additional circuit which is parallel to each of circuit 226 and 230 and circuit 228 and 232 and which is connected to an additional mercury switch which is normally closed with the mercury is in the center. In this embodiment, when power is turned on by closing switch 212, power is supplied to this normally closed switch as well as the other two normally open switches 204 and 205. The circuit for this additional switch is broken when it is tilted from the level position causing the mercury to move away from center, causing the green light to go off, and a red light powered by one or the other of the other two switches 204 and 205 is caused to come on.

The tilt indicator light is thus provided as the sight pin 30 to remove the distraction of the shooter having to focus on a separate indicator light while using a sight pin for aiming, whereby greater accuracy and faster response time may advantageously be achieved.

The component box 6 and its contents and the photo optic cable 15 along with a suitable bracket may be provided as a kit for attachment to a sighting device such as a device manufactured by Toxonics Manufacturing, Inc. of Weatzville, Mo. and identified as T-4000 or such as a device shown in U.S. Pat. No. 5,630,279, which is hereby incorporated herein by reference and which is assigned to Toxonics Manufacturing, Inc. The bracket therefor is suitably sized and shaped and used to attach the component box 6 to the sighting device using principles commonly known to those of ordinary skill in the art to which this invention pertains. The cable sight point end 30 is fed into the cross hairs hole in the sighting lens. In order to insure that the cable 15 doesn't disengage from the hole, its end, after passage through the hole, may be melted slightly about its outer surface and allowed to cool to form an obstruction to passage of the cable end back through the hole.

Figure 11:
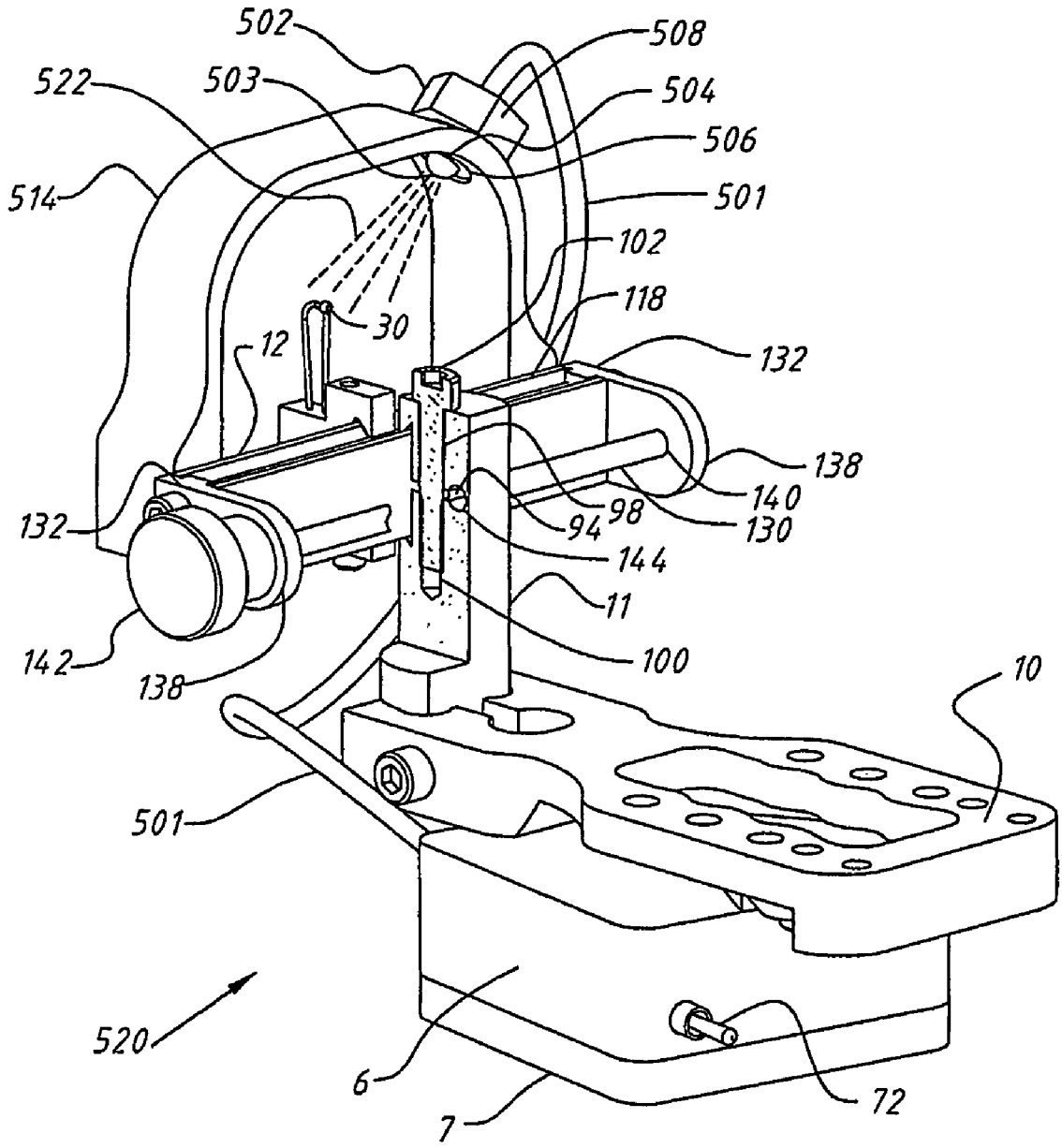
FIGS. 11 and 12 are views similar to those of FIGS. 2 and 5 respectively illustrating an alternative embodiment of the present invention.
Figure 12:
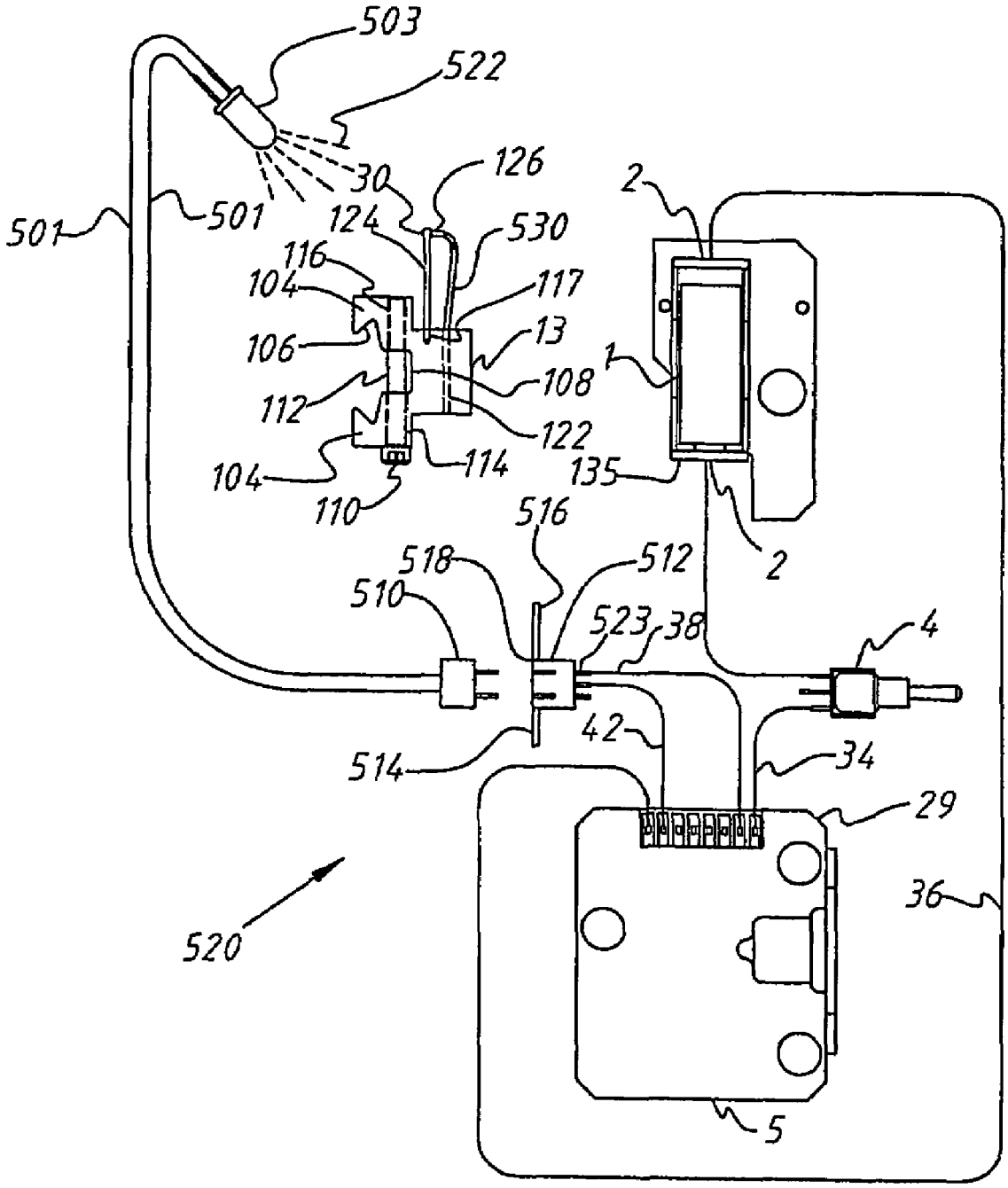

Referring to FIGS. 11 and 12, there is shown generally at 520 a sighting device in accordance with an alternative embodiment of the present invention. The sighting device 520 is similar to sighting device 20 and contains similar parts except as discussed hereinafter.

As seen in FIG. 11, an LED (light emitting diode) 503 is electrically attached to a pair of wires 501 and is suitably mounted in the guard member 514, which is otherwise similar to guard member 14. The LED 503 is pressed into a center hole 504 in a holder or housing 502 for the LED 503. The holder 502 has a threaded portion 506 which is threadedly received in a threaded aperture 507 in the guard member 514 and an enlarged hex portion 508 for application of a wrench for screwing the holder 502 into the threaded aperture 507 and suitably tightening.

As seen in FIG. 12, the wires 501 are electrically connected (soldered) to a suitable electrical plug 510, which plugs into a suitable electrical socket 512. The socket 512 is disposed within a box 514, which is similar to box 6, adjacent the forward wall 516, which is similar to forward wall 64. The socket 512 is formed as part of or otherwise suitably molded into the box 514 or otherwise suitably secured adjacent the forward wall 516. A cutout, illustrated at 518, is provided in the forward wall 516 to allow access of the plug 510 to the socket 512. Electrical prongs 523 of the socket 512 are electrically connected to wires 38 and 42 respectively to complete the circuit for supplying electricity to the LED 503 for lighting thereof. Although a blue LED 503 seems to work best, any color LED 503 should suitably work. Thus, instead of being disposed within the box, as in FIGS. 1 to 10, the LED 503 of FIGS. 11 and 12 is disposed to protrude from the inner surface of the guard member 514 in a suitable position to emit light, as illustrated at 522, onto the structure, as hereinafter described, containing the sight pin. As seen in FIGS. 11 and 12, the LED 503 is mounted in the wall of the guard member 514 so as not to obstruct the line of sight at the sight pin 30 of the shooting instrument.

Suitably mounted in the sight pin holder 13 is the bracing member 124, similarly as for the embodiment of FIGS. 1 to 10, and a fluorescent sight pin 530. Unlike photo optic cable 15 of the embodiment of FIGS. 1 to 10, which passes light from one end to the other, a fluorescent sight pin is composed of material which collects light from its surroundings. As a result, the brightness of the fluorescent sight pin 530 increases over its length and, it has been noted, especially at the end or sight point 30. Suitable fluorescent sight pins (which may otherwise be called fiber optic pins) are marketed by Truglo, Inc. of McKinney, Tex.; Extreme Archery Products of Ashland, Ky.; Copper John Corp. of Auburn, N.Y.; and Cobra Mfg. Co., Inc. of Bixby, Okla.

The fluorescent sight pin 530 may be mounted otherwise than as shown in FIGS. 11 and 12. For example, the ends of the sight pin 530 and bracing member 124 may be secured in a housing which is attached in a rail, the rail being formed in a member to which the guard member 514, which may be circular or otherwise suitably shaped, is attached. The rail allows the position of the sight pin to be adjusted. There may be more than one rail for receiving a plurality such as, for example, four of the sight pins spaced vertically for uses at respectively different ranges.

If desired, a level, which is typically supplied with a conventional bow sight, may be provided with the sighting device of the present invention for purposes of calibrating the sighting device and as a check to provide assurance that the light is in fact activated when the bow is within the predetermined range of side-wise tilt. Such a level is shown in the aforesaid U.S. Pat. No. 5,339,227, which patent is hereby incorporated herein by reference.

It should be understood that, while the present invention has been described in detail herein, the invention can be embodied otherwise without departing from the principles thereof, and such other embodiments are meant to come within the scope of the present invention as defined by the appended claims.

What is claimed is:

1. In combination with a shooting instrument, a sighting device comprising a member positioned to provide a sight point for the shooting instrument wherein said sight point is in a line of sight when the shooting instrument is held in a position for shooting, an indicator of orientation of the shooting instrument within a predetermined angle of side-wise tilt about the line of sight, an initiator of light to said member for effecting increased brightness of the sight point, said initiator being responsive to an indication of said indicator that the orientation of the shooting instrument is within said predetermined angle of side-wise tilt to increase brightness of said sight point.

2. The combination according to claim 1 wherein said member is a light transmitting member having a first end for receiving light from said initiator and a second end providing the sight point at which second end the received light is emitted.

3. The combination according to claim 1 wherein said member is a fluorescent member having an end providing the sight point, and said initiator is spaced from said fluorescent member in position to emit light onto said fluorescent member without obstructing a line of sight of the shooting instrument.

4. A combination according to claim 1 wherein said indicator includes an inclinometer having a fluid therein, the combination further includes means for orienting said inclinometer to provide indications of side-wise tilt when shooting downwardly if from a tree stand as well as horizontally.

5. A combination according to claim 1 wherein said predetermined angle is about 1 degree, clockwise or counterclockwise.

6. A combination according to claim 1 wherein the shooting instrument is a bow.

7. A combination according to claim 1 wherein said initiator is a light emitting diode.

8. A sighting device for use with a shooting instrument, the sighting device comprising a housing, a member positioned to provide a sight point for the shooting instrument wherein said sight point is in a line of sight when the shooting instrument is held in a position for shooting, an indicator of orientation of the shooting instrument within a predetermined angle of side-wise tilt about the line of sight, an initiator of light to said member to effect increased brightness of the sight point, said initiator being responsive to an indication of said indicator that the orientation of the shooting instrument is within said predetermined angle of side-wise tilt to increase brightness of said sight point, said initiator being spaced from said member in position to emit light onto said member without obstructing a line of sight of the shooting instrument, and at least one bracket for attaching the device to the shooting instrument.

9. A sighting device according to claim 8 wherein said indicator includes an inclinometer having a fluid therein, the combination further includes means for orienting said inclinometer to provide indications of side-wise tilt when shooting downwardly from a tree stand as well as horizontally.

10. A sighting device according to claim 8 wherein the shooting instrument is a bow.

11. A sighting device according to claim 8 wherein said predetermined angle is about 1 degree, clockwise or counterclockwise.

12. A sighting device for use with a shooting instrument, the sighting device comprising a housing, a light transmitting flexible tubular member having a first end disposed within said housing for receiving light and a second end disposed outside said housing and at which second end the received light is emitted, said tubular member having a length and disposed to position said second end as a sight point for the shooting instrument wherein said sight point is in a line of sight when the shooting instrument is held in a position for shooting, an indicator within said housing of orientation of the shooting instrument within a predetermined angle of side-wise tilt about the line of sight, an initiator of light to said first end which initiator is within said housing and adjacent said first end and is responsive to an indication of said indicator that the orientation of the shooting instrument is within said predetermined angle, and at least one bracket for attaching said housing to the shooting instrument.

13. A sighting device according to claim 12 wherein said initiator is a light emitting diode which diode is positioned adjacent said first end.

14. A sighting device according to claim 12 including a brace for said second end, said brace having an aperture for receiving said tubular member at the sight point.

15. A sighting device according to claim 12 including means for adjusting the sight point position.

16. A sighting device according to claim 12 wherein said predetermined angle is about 1 degree, clockwise or counterclockwise.

* * * * *